US009063507B2

(12) United States Patent
Gofuku et al.

(10) Patent No.: US 9,063,507 B2
(45) Date of Patent: Jun. 23, 2015

(54) DEVELOPMENT DEVICE, PROCESS CARTRIDGE, AND IMAGE FORMING APPARATUS

(71) Applicant: CANON KABUSHIKI KAISHA, Tokyo (JP)

(72) Inventors: Shuichi Gofuku, Numazu (JP); Yu Fukasawa, Tokyo (JP); Hiroki Shimizu, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/035,127

(22) Filed: Sep. 24, 2013

(65) Prior Publication Data

US 2014/0086599 A1 Mar. 27, 2014

(30) Foreign Application Priority Data

Sep. 26, 2012 (JP) ..... 2012-212540

(51) Int. Cl.
*G03G 15/08* (2006.01)
*G03G 21/00* (2006.01)

(52) U.S. Cl.
CPC ..... *G03G 21/00* (2013.01); *G03G 15/0862* (2013.01)

(58) Field of Classification Search
USPC ..... 399/24–30, 107, 110, 111, 119, 120, 399/252–262
See application file for complete search history.

(56) References Cited

U.S. PATENT DOCUMENTS 7,224,925 B2 * 5/2007 Sato et al. ..... 399/263
7,761,027 B2 * 7/2010 Takami ..... 399/100

FOREIGN PATENT DOCUMENTS

JP 2001-318524 A 11/2001
JP 2010-9021 A 1/2010

* cited by examiner

*Primary Examiner* — Hoan Tran
(74) *Attorney, Agent, or Firm* — Canon USA Inc IP Division

(57) ABSTRACT

A development device includes a developer storage chamber configured to store a developer, a developer carrying member configured to carry the developer, a light transmission member capable of transmitting detection light for detecting a remaining amount of a developer in the developer storage chamber, a shaft member which is provided to the developer storage chamber and configured to rotate, a conveyance unit which is provided to the shaft member and configured to convey the developer, and a cleaning unit which is provided to the shaft member and configured to rub and clean the light transmission member, wherein the shaft member includes an opening.

11 Claims, 8 Drawing Sheets

DEVELOPMENT DEVICE, PROCESS CARTRIDGE, AND IMAGE FORMING APPARATUS

BACKGROUND OF THE INVENTION

1. Field of the Invention

The present disclosure relates to a development device to be used in an electrophotographic image forming apparatus, and a process cartridge to be detachably mounted to the electrophotographic image forming apparatus.

Here, the electrophotographic image forming apparatus is an apparatus for forming an image on a recording material by employing electrophotographic image forming processing. The electrophotographic image forming apparatus includes, for example, an electrophotographic copying machine, an electrophotographic printer (for example, a laser light printer and a light-emitting diode (LED) printer), and a facsimile apparatus.

The process cartridge is formed by integrally combining a charging unit, a development unit or a cleaning unit and an image bearing member into a cartridge so as to be detachably mounted to an apparatus main body of the electrophotographic image forming apparatus. Specifically, the process cartridge includes at least a development unit and an image bearing member integrally combined so as to be detachably mounted to the apparatus main body.

2. Description of the Related Art

In an electrophotographic image forming apparatuses employing an electrophotographic process, a process cartridge system has been employed in which an electrophotographic photosensitive drum and a process unit acting on the electrophotographic photosensitive drum are integrally combined into a cartridge to be detachably mounted to an apparatus main body. The process cartridge system enables a user to perform maintenance of the apparatuses without relying on a service person. Thus, the operability can be significantly increased. Consequently, the process cartridge method has been widely used in the electrophotographic image forming apparatuses.

In the process cartridge system, to enable a user to smoothly replace the cartridge, generally, a developer remaining amount detection function for detecting a remaining amount of a developer and displaying the detection result for the users is provided. As a developer remaining amount detection method, a light-transmission type developer remaining amount detection method has been widely employed. In this method, a light emitting element such as an LED and a light receiving element such as a phototransistor which are attached to an image forming apparatus main body form a light path passing through a developer storage chamber. Based on a time period the developer blocks the light path, a remaining amount of the developer is detected (Japanese Patent Application Laid-Open No. 2001-318524).

A development device discussed in Japanese Patent Application Laid-Open No. 2010-9021 employs a structure in which a cleaning unit cleans a light transmission member through which detection light passes to increase a detection accuracy in the light-transmission type developer remaining amount detection. In this structure, a conveyance unit provided to a rotating shaft member conveys a developer in a developer storage chamber in a direction of a development roller, and the cleaning unit follows the rotation of the conveyance unit to rub and clean the light transmission member.

In such a conventional development device described above, a part of the developer, which is not conveyed by the conveyance unit and remains on an upstream side of the conveyance unit and on a downstream side of the cleaning unit, is conveyed by adhering to a surface of the cleaning unit. If a large amount of the developer adheres to the surface of the cleaning unit, the developer may prevent the cleaning unit from rubbing and cleaning the light transmission member. The prevention of the cleaning of the light transmission member by the cleaning unit may decrease the detection accuracy in the developer remaining amount detection.

SUMMARY OF THE INVENTION

The present disclosure is directed to a development device capable of reducing a developer that adheres to a cleaning unit and stably performing cleaning of a light transmission member.

According to an aspect disclosed herein, a development device includes a developer storage chamber configured to store a developer, a developer carrying member configured to carry the developer, a light transmission member capable of transmitting detection light for detecting a remaining amount of a developer in the developer storage chamber, a shaft member which is provided to the developer storage chamber and configured to rotate, a conveyance unit which is provided to the shaft member and configured to convey the developer, and a cleaning unit which is provided to the shaft member and configured to rub and clean the light transmission member. The shaft member includes an opening.

Further features of the present invention will become apparent from the following description of exemplary embodiments with reference to the attached drawings.

DESCRIPTION OF THE EMBODIMENTS

Figure 2:
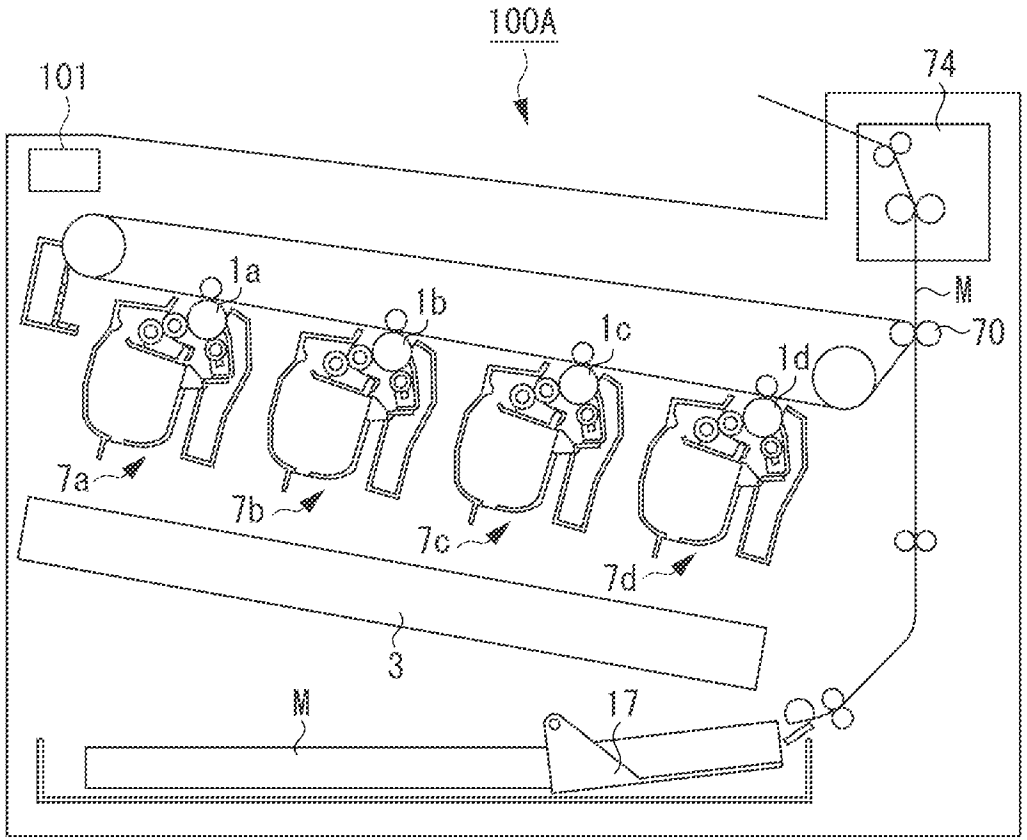
FIG. 2 illustrates an overall configuration of an image forming apparatus according to the first exemplary embodiment.

Hereinbelow, a first exemplary embodiment is described. FIG. 2 illustrates an overall configuration of a full-color laser light printer as an example of an image forming apparatus.

First, with reference to FIG. 2, an electrophotographic image forming apparatus 100A to which the exemplary embodiment is to be applied will be described. FIG. 2 illustrates the electrophotographic image forming apparatus (laser light printer) 100A to which a process cartridge 7 is mounted according to the first exemplary embodiment. In the electrophotographic image forming apparatus 100A, information light (laser light) based on image information is emitted from an optical system 3 to a photosensitive drum 1, and an electrostatic latent image is formed on the photosensitive drum 1 functioning as an image bearing member. The electrostatic latent image is developed with a developer 30 and a developer image is formed. In synchronization with the formation of the developer image, a recording medium M is conveyed from a sheet cassette 17, and the developer image formed on the photosensitive drum 1 is transferred onto the recording medium M by a transfer unit 70. The transferred developer image is fixed onto the recording medium M by a fixing unit 74, and then, the recording medium M is discharged.

(Structure of Process Cartridge)

Figure 3:
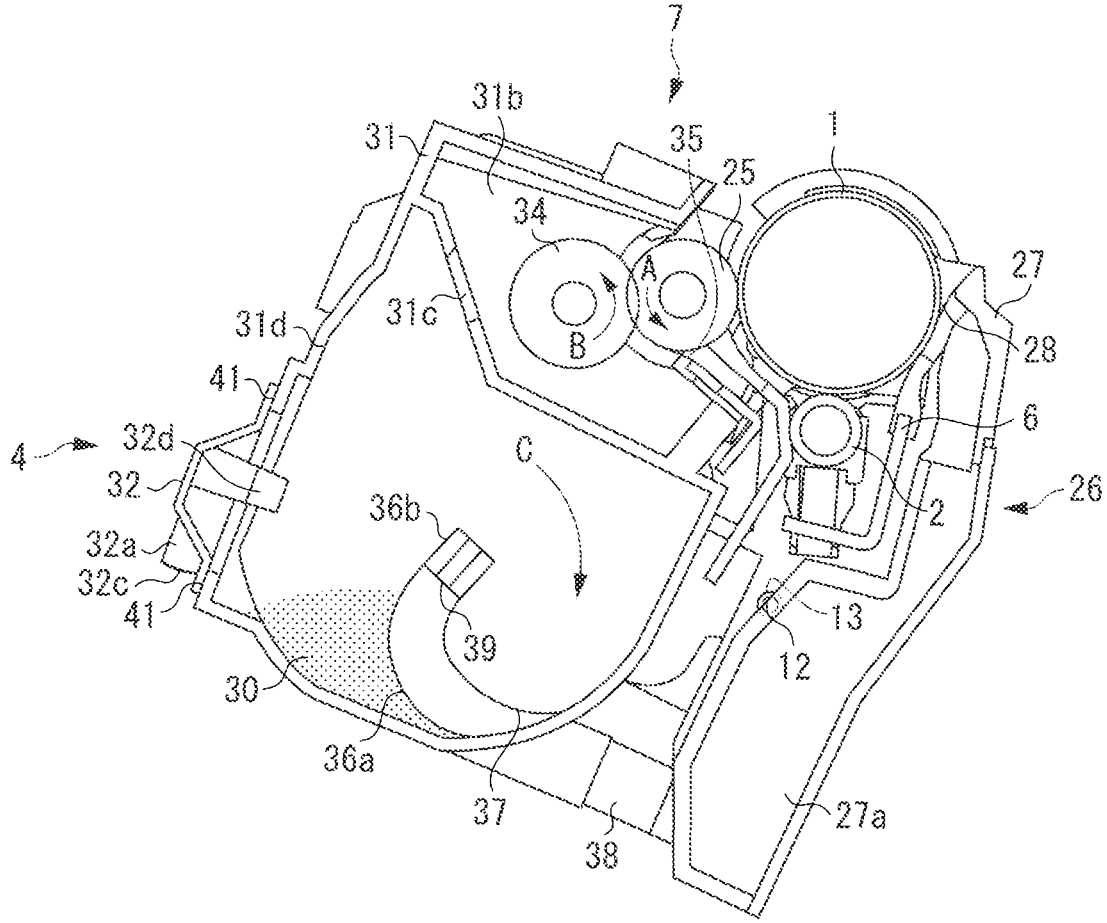
FIG. 3 is a cross-sectional view illustrating a process cartridge according to the first exemplary embodiment.

A process cartridge according to the present exemplary embodiment is described. FIG. 3 is a cross-sectional view illustrating main components of the process cartridge 7. A process cartridge 7*a*, a process cartridge 7*b*, a process cartridge 7*c*, and a process cartridge 7*d* respectively storing developers 30 of yellow, magenta, cyan, and black have the same basic structure.

As illustrated in FIG. 3, the process cartridge 7 according to the first exemplary embodiment includes a drum unit 26 and a development device 4. The process cartridge 7 is detachably mounted on an image forming apparatus main body (a part of the image forming apparatus 100A except the process cartridge).

The drum unit 26 includes a charging roller 2 serving as a primary charging unit on a circumference of the photosensitive drum 1. The drum unit 26 also includes a flexible sheet member 28 for preventing a transfer residual developer (i.e. a waste developer leakage) from leaking from a gap between the photosensitive drum 1 and a cleaning frame 27. The drum unit 26 also includes a cleaning member 6 for removing the waste developer remaining on the surface of the photosensitive drum 1. The waste developer removed from the surface of the photosensitive drum 1 by the cleaning member 6 is stored in a waste developer chamber 27*a* provided in the cleaning frame 27.

A container supporting structure of the development device 4 has a structure pivotably supported to the drum unit 26. More specifically, connection holes (not illustrated) disposed on the both ends of the development device 4 are fit to supporting holes 13 disposed on the both ends of the cleaning frame 27 of the drum unit 26, and pins 12 are inserted into the holes from both ends of the drum unit 26. In the development device 4, a pressure spring 38 constantly urges the development device 4 to rotate about the supporting holes 13, so that a development roller 25 contacts with the photosensitive drum 1. According to the present exemplary embodiment, the development roller 25 serves as a developer carrying member for carrying the developer to develop an electrostatic latent image on the photosensitive drum.

The development device 4 includes a development frame 31, the development roller 25 which contacts with the photosensitive drum 1 to rotate in a direction indicated by an arrow A in the drawing, and a developer conveyance unit 36 for conveying the developer 30 stored in a developer storage portion (developer storage chamber) 31*a* to a development chamber 31*b*.

Figure 4A:
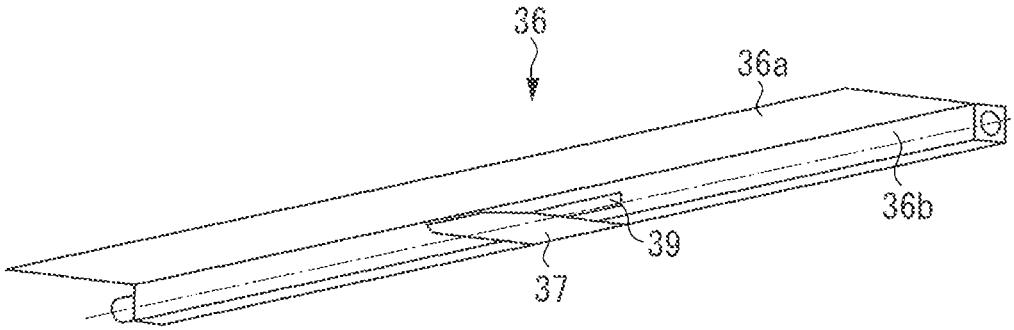
FIGS. 4A and 4B are perspective views illustrating a developer conveyance unit according to the first exemplary embodiment.
Figure 4B:
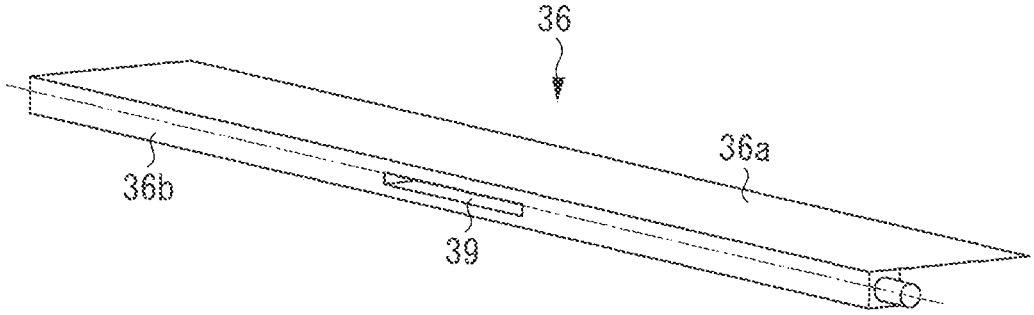

FIGS. 4A and 4B illustrate the developer conveyance unit 36. The developer conveyance unit 36 includes a conveyance member (conveyance unit) 36*a* made of a flexible sheet member, and a rotating shaft 36*b* serving as a shaft member. By the rotation of the conveyance member 36*a* about the rotating shaft 36*b* as a pivot axis, the developer passes from the developer storage portion 31*a* through a development chamber opening portion 31*c*, and is conveyed to the development chamber 31*b*.

On a side wall of the developer storage portion 31*a*, a light transmission member 32 serving as a remaining amount detection unit is provided. The light transmission member 32 can transmit detection light for detecting a remaining amount of the developer in the developer storage portion 31*a*. The rotating shaft 36*b* is provided with a cleaning member (cleaning unit) 37 for cleaning the light transmission member 32. When the developer conveyance unit rotates, the cleaning member 37 rubs and cleans the light transmission member 32 to remove the developer 30 adhering to the light transmission member.

The rotating shaft 36*b* is provided with an opening 39 located on an upstream side in a rotational direction of the developer conveyance unit 36 than the conveyance member 36*a*, and on a downstream side in the rotational direction of the developer conveyance unit 36 than the cleaning member 37. The opening 39 is located, with respect to the axial direction of the rotating shaft 36*b*, at a position overlapping with an installation position of the cleaning member 37.

On a circumference of the development roller 25, a developer supplying roller 34 that contacts with the development roller 25 to rotate in a direction indicated by an arrow B in the drawing, and a development blade 35 for thinning the developer 30 as a layer are disposed.

The developer 30 applied on the development roller 25 is conveyed, with the rotation of the development roller 25, to a developing portion where the photosensitive drum 1 and the development roller 25 face with each other. In the developing portion, the developer 30 on the development roller 25 adheres to an electrostatic latent image formed on the surface of the photosensitive drum 1 by a development bias applied from a power source (not illustrated). Accordingly, the electrostatic latent image is developed as a visible image. The developer 30 which is not used in the development of the electrostatic latent image and remains on the surface of the development roller 25 is returned and collected in the development chamber 31*b* with the rotation of the development roller 25.

(Configuration of Remaining Amount Detection Unit)

Figure 5:
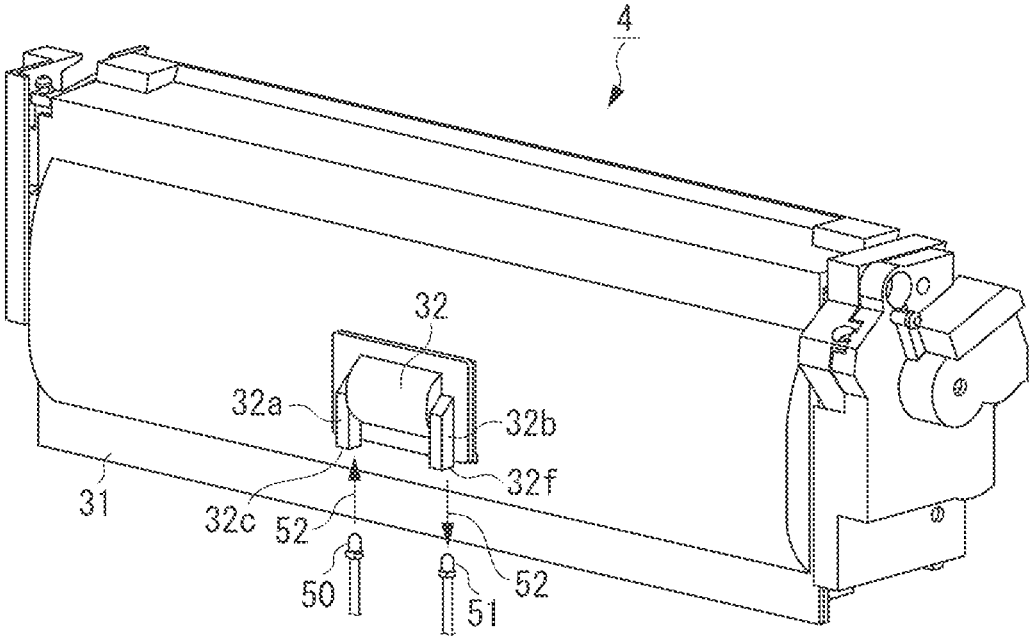
FIG. 5 illustrates a light transmission member and the surroundings according to the first exemplary embodiment viewed from the outside of a developer storage chamber.
Figure 6:
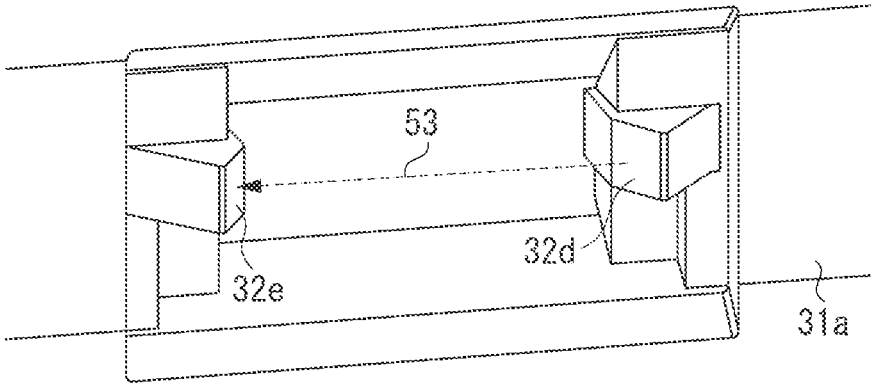
FIG. 6 illustrates the light transmission member according to the first exemplary embodiment.

With reference to FIGS. 5 and 6, a configuration of the light transmission member 32 that is provided to the development device 4 and serves as a remaining amount detection unit will be described.

FIG. 5 is a perspective view of the light transmission member 32 and the surroundings viewed from the outside of the developer storage portion 31*a*. FIG. 6 is a perspective view of the light transmission member 32 and the surroundings viewed from the inside of the developer storage portion 31*a*. As illustrated in FIGS. 5 and 6, on the side wall of the developer storage portion 31*a*, the light transmission member 32 serving as the remaining amount detection unit for detecting an amount of a remaining developer is provided. On the outside of the developer storage portion 31*a*, a light emitting element 50 and a light receiving element 51 provided to the image formation apparatus main body are disposed. The light transmission member 32 includes a light emitting side light guiding portion 32*a* and a light receiving side light guiding portion 32*b* combined in one unit. The light emitting side light guiding portion 32*a* is used to guide detection light 52 emitted from the light emitting element 50 to the inside of the developer storage portion 31*a*. The light receiving side light guiding portion 32*b* is used to guide the detection light 52 that has passed through the developer storage portion 31*a* to the light receiving element 51. The light emitting side light guiding portion 32*a* includes an incident portion 32*c* from which the detection light 52 emitted from the light emitting element 50 enters the light emitting side light guiding portion 32*a*, and a light emitting side window 32*d* from which the detection light 52 entered the light emitting side light guiding portion 32*a* is output to the inside of the developer storage chamber 31*a*. Similarly, the light receiving side light guiding portion 32*b* includes a light receiving side window 32*e* from which the detection light 52 that has passed through the inside of the developer storage chamber 31*a* enters the light receiving side light guiding portion 32*b*, and an output portion 32*f* from which the detection light 52 entered the light receiving side light guiding portion 32*b* is output to the light receiving element 51. The light emitting side window 32*d* and the light receiving side window 32*e* are disposed to face each other, so that a light path 53 where the detection light 52 passes through is formed between the windows. However, in a case where the light path 53 is formed in consideration of refraction of light occurring in the emission from the light emitting side window 32*d*, or in entering the light receiving side window 32*e*, the configuration is not limited to the above configuration in which the light emitting side window 32*d* and the light receiving side window 32*e* are disposed to face each other.

(Method for Remaining Amount Detection)

With reference to FIGS. 5 and 6, a method for remaining amount detection by the light transmission member 32 will be described. As illustrated in FIG. 5, at the time of the remaining amount detection, the detection light is emitted from the light emitting element 50. The emitted detection light 52 enters the incident portion 32*c*, and as illustrated in FIG. 6, the light is guided from the light emitting side window 32*d* into the developer storage portion 31*a*. The detection light 52 emitted from the light emitting side window 32*d* enters the light receiving side window 32*e* disposed to face thereto. At this time, the light path 53 is formed between the light emitting side window 32*d* and the light receiving side window 32*e*. Then, the detection light 52 entered from the light receiving side window 32*e* is output from the output portion 32*f* toward the light receiving element 51, and is received by the light receiving element 51. Based on an output of the light receiving element 51, a detection unit 101 in a central processing unit (CPU) detects that the detection light 52 passed through the developer storage portion 31*a*.

Figure 1:
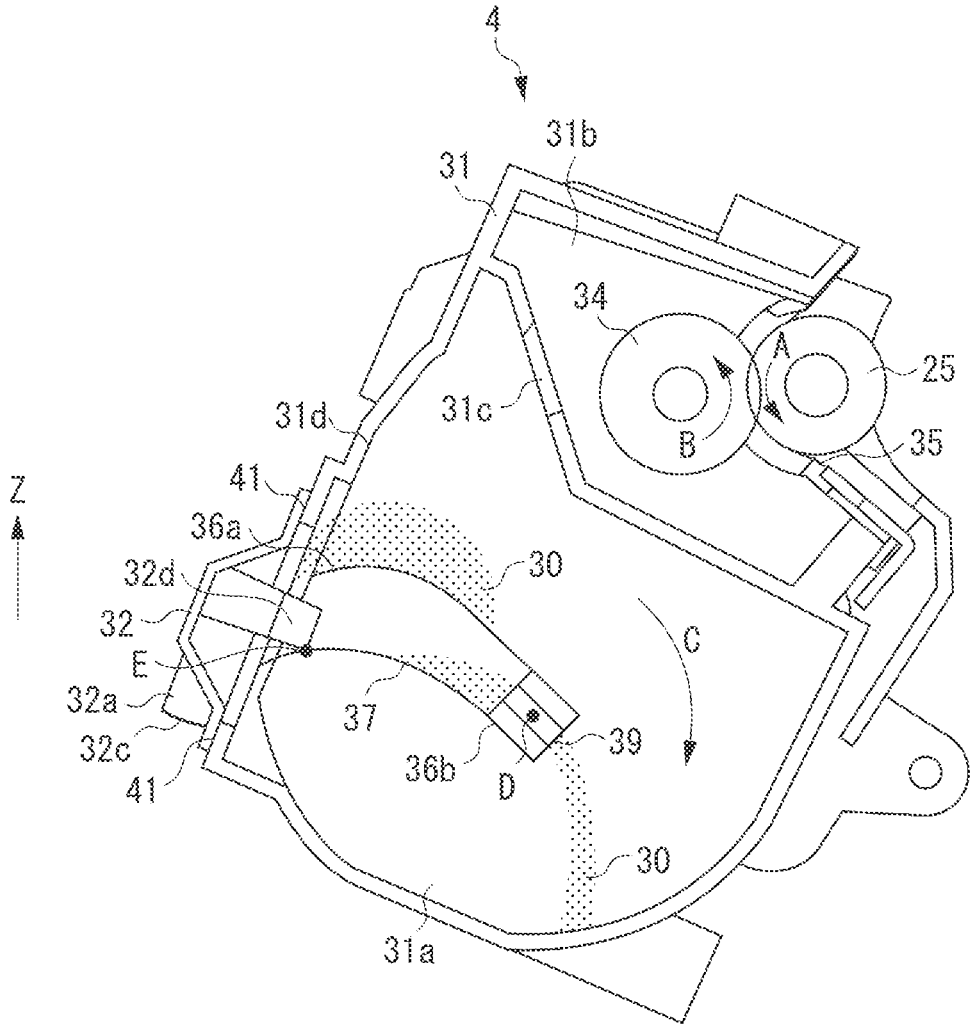
FIG. 1 is a cross-sectional view illustrating a development device in which a developer is falling from an opening provided to a rotating shaft according to a first exemplary embodiment.
Figure 7:
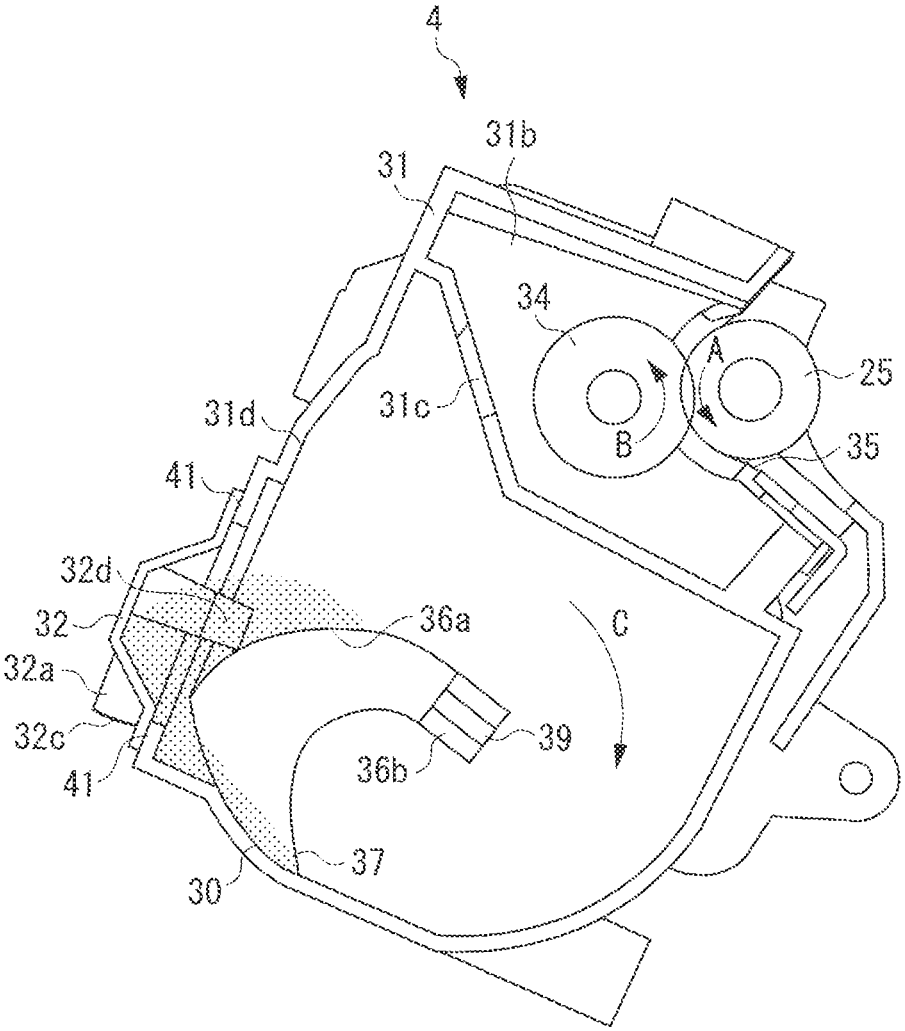
FIG. 7 is a cross-sectional view illustrating a development device in which a developer is passing over the light transmission member according to the first exemplary embodiment.

A mechanism of the light-transmission type developer remaining amount detection according to the present exemplary embodiment is described. FIG. 1 is a cross-sectional view illustrating a state right after the developer has passed over the light transmission member 32. FIG. 7 is a cross-sectional view illustrating a state the developer 30 is passing over the light transmission member 32. When the developer does not exist over the light transmission member 32, the light path 53 is formed. Meanwhile, as illustrated in FIG. 7, while the developer 30 is passing over the light transmission member 32, the light path 53 is blocked by the developer 30, and the detection light 52 is not detected by the light receiving element 51. As illustrated in FIG. 1, after the developer 30 has passed over the light transmission member 32, the light path 53 is formed again, and the detection light 52 can be detected by the light receiving element 51. In a state a developer remaining amount in the developer storage portion 31*a* is large, before and after the state illustrated in FIG. 7, an amount of the developer 30 passing over the light transmission member 32 is large, and the passing time is also long. Thus, a time period that the light path 53 is blocked is long. On the other hand, in a state that the developer remaining amount is small, the amount of the developer 30 passing over the light transmission member 32 is small, and the passing time is also short. Thus, the time period that the light path 53 is blocked is short. As described above, depending on the developer remaining amount in the developer storage portion 31*a*, the length of time that the light receiving element 51 can receive the light varies. Consequently, based on the output of the light receiving element 51, the remaining amount of the developer 30 can be detected by the detection unit 101 from the time that the detection light 52 is blocked.

When the developer 30 passes over the light transmission member 32, however, the developer 30 adheres to the light emitting side window 32*d* and the light receiving side window 32*e*, and often interferes with the detection light 52. The adhesion may elongate the time the light path 53 to be blocked than usual, and thus, the remaining amount of the developer 30 cannot be detected accurately. To solve such an issue, the rotating shaft 36*b* is provided with the cleaning member 37 that is formed from a flexible sheet member for wiping off the developer 30 adhering to the light emitting side window 32*d* and the light receiving side window 32*e*. In order to reduce the lowering of the detection accuracy due to the developer adhesion as much as possible, the cleaning member 37 is disposed at a phase capable of immediately wiping the light emitting side window 32*d* and the light receiving side window 32*e* after the conveyance member 36*a* conveying the developer has passed over the light transmission member 32.

(Method for Cleaning Light Transmission Member 32 by Cleaning Member 37)

With reference to FIG. 7, a method for conveying the developer 30 will be described. When the developer conveyance unit 36 rotates about the rotating shaft 36*b* as the pivot axis in a direction indicated by an arrow C in the drawing, the conveyance member 36*a* rubs on the side wall of the developer storage portion 31*a* and deforms. At that time, the conveyance member 36*a* rotates while carrying the developer 30 on its surface. When the conveyance member 36*a* rotates to a release position 31*d* of the developer storage portion 31*a*, due to an elasticity of the conveyance member 36*a*, the contact with the developer storage portion 31*a* is released. A restoring force in the release of the conveyance member 36*a* conveys the developer 30 through the development chamber opening portion 31*c* to the development chamber 31*b*.

The conveyance member 36*a* rubs on the developer storage portion 31*a*, so that the developer 30 is conveyed. At this time, a part of the developer 30 which is not conveyed by the conveyance member 36*a* and remains on the upstream side of the conveyance member 36*a* and on the downstream side of the cleaning member 37 is conveyed by adhering to the surface of the cleaning member 37. Especially, as illustrated in FIG. 7, if uneven portions exist on a part of the developer storage portion 31*a*, such as an attachment portion 41 of the light transmission member 32, the developer 30 falls from the conveyance member 36*a* and tends to remain on the upstream side in the rotational direction of the conveyance member 36*a* and on the downstream side of the cleaning member.

If a large amount of the developer 30 remains on the surface of the cleaning member 37, the developer 30 may prevent the cleaning member 37 from rubbing and cleaning the light emitting side window 32*d* and the light receiving side window 32*e*. In addition, when the contact states between the light emitting side window 32*d* and the cleaning member 37, and between the light receiving side window 32*e* and the cleaning member 37 are released, the developer 30 on the cleaning member 37 may scatter and adhere to the light emitting side window 32*d* and the light receiving side window 32*e* after the cleaning. If the cleaning by the cleaning member 37 cannot be stably performed, the light transmission time may vary.

To solve such an issue, according to the present exemplary embodiment, the rotating shaft 36*b* is provided with the opening 39 at a position on the upstream side than the conveyance member 36*a* and on the downstream side than the cleaning member 37 in the rotational direction of the rotating shaft 36*b*. In addition, a height E in the direction of gravity Z of the light emitting side window 32*d* and the light receiving side window 32*e* is set to a position higher than the rotation center D of the developer conveyance unit 36 (in other words, the cleaning member 37 is configured to rub and clean the light transmission member 32 at a position higher than the rotation center D of the rotating shaft 36*b*). By employing such a configuration, as illustrated in FIG. 1, the developer 30 conveyed by the cleaning member 37 falls through the opening 39 provided to the rotating shaft 36*b*, so that the amount of the developer 30 to be carried on the surface of the cleaning member 37 can be reduced. Accordingly, the cleaning of the light transmission member 32 by the cleaning member 37 can be stably performed, and the variation in the light transmission time due to the uneven cleaning can be reduced. As a result, the development device 4 having improved accuracy in the light-transmission type developer remaining amount detection for detecting light transmission time can be provided.

Figure 8A:
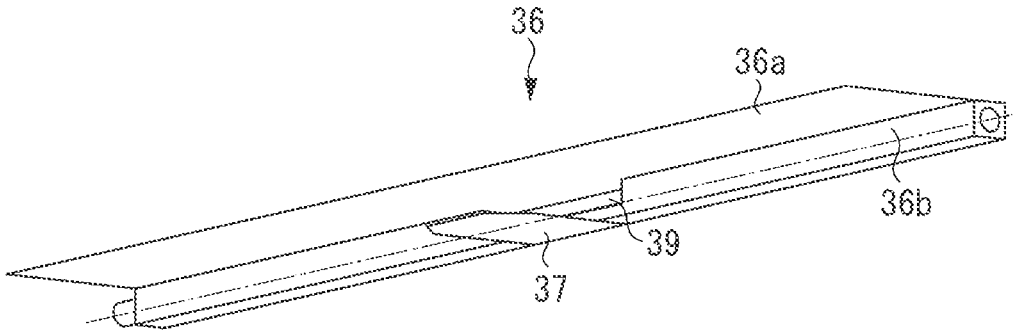
FIGS. 8A and 8B are perspective views illustrating another shape of an opening according to the first exemplary embodiment.
Figure 8B:
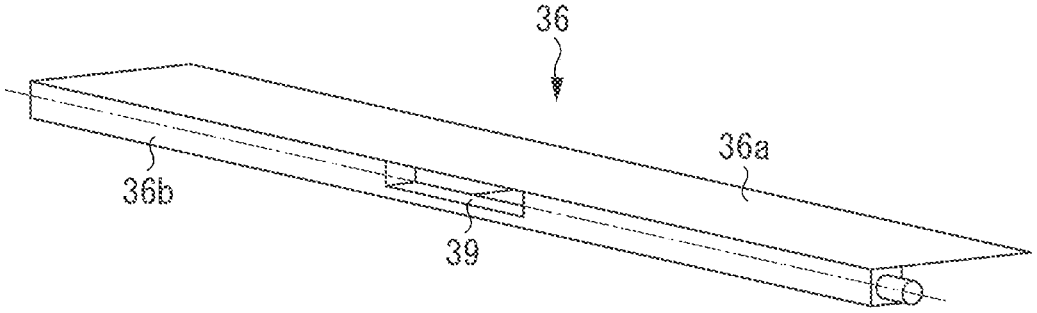

According to the present exemplary embodiment, as a shape of the opening 39, a hole shape penetrating through the rotating shaft 36*b* as illustrated in FIG. 1 and FIGS. 4A and 4B, is employed. Alternatively, to reduce the developer on the cleaning member 37, a slit shape (concave shape) as illustrated in FIGS. 8A and 8B can be employed. In FIGS. 8A and 8B, the opening 39 is a slit extended in the direction intersecting with the axis of the rotating shaft 36*b*. The term "slit" means to include a structure in which a slit width in the axial direction of the rotating shaft 36*b* is longer than that in the extended direction of the slit, and a structure in which a slit width in the axial direction of the rotating shaft 36*b* is shorter than that in the extended direction of the slit. The developer on the cleaning member 37 can be reduced by providing the concave opening 39 at a position on the upstream side than the conveyance member 36*a* and the downstream side than the cleaning member 37 in the rotational direction of the rotating shaft 36*b*. Accordingly, effects similar to those according to the present exemplary embodiment can be obtained. To effectively reduce the developer on the cleaning member 37, however, it is desirable to employ the through hole according to the present exemplary embodiment.

According to the present exemplary embodiment, the opening 39 and the cleaning member 37 are provided in the same plane perpendicular to the axis of the rotating shaft 36*b*. This structure is not always necessary to obtain the effects according to the present exemplary embodiment, however, the structure can effectively reduce the developer on the cleaning member 37.

According to the present exemplary embodiment of the present disclosure, by providing the opening to the shaft member, the developer on the cleaning unit can be reduced before the cleaning unit rubs and cleans the light transmission member. By this structure, the development device capable of stably performing the cleaning the light transmission member by the cleaning unit can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-212540 filed Sep. 26, 2012, which is hereby incorporated by reference herein in its entirety.

What is claimed is:

1. A development device comprising:

a developer storage chamber configured to store a developer;

a developer carrying member configured to carry the developer to develop an electrostatic latent image;

a light transmission member for transmitting detection light for detecting a remaining amount of a developer in the developer storage chamber;

a shaft member that is provided to the developer storage chamber and configured to rotate;

a conveyance unit that is provided to the shaft member and configured to convey the developer; and a cleaning unit that is attached to the shaft member and configured to clean the light transmission member, wherein the shaft member includes an opening at a position on an upstream side of the conveyance unit and on a downstream side of the cleaning unit in a rotational direction of the shaft member.

2. The development device according to claim 1, wherein the opening and the cleaning unit are provided on a same plane perpendicular to an axis of the shaft member.

3. The development device according to claim 1, wherein the opening is a through hole.

4. The development device according to claim 1, wherein the opening is a slit extended in a direction intersecting with the axis of the shaft member.

5. The development device according to claim 1, wherein the conveyance unit is a flexible sheet member.

6. The development device according to claim 1, wherein the cleaning unit is a flexible sheet member.

7. A process cartridge including an image bearing member configured to carry an electrostatic latent image and the development device according to claim 1, and detachably mounted on an image forming apparatus main body.

8. An image forming apparatus for forming an image on a recording medium, the image forming apparatus comprising:

an image bearing member configured to carry an electrostatic latent image;

the development device according to claim 1;

a light emitting element configured to emit the detection light;

a light receiving element configured to receive the detection light passed through the developer storage chamber; and a detection unit configured to detect a remaining amount of a developer in the developer storage chamber based on an output of the light receiving element.

9. The development device according to claim 1, wherein a cleaning unit that is attached to the shaft member and configured to clean the light transmission member at a position higher than a rotation center of the shaft member.

10. A development device comprising:

a developer storage chamber configured to store a developer;

a developer carrying member configured to carry the developer;

a shaft member that is provided to the developer storage chamber and configured to rotate;

a conveyance unit that is provided to the shaft member and configured to convey the developer; and a sheet member that is provided to the shaft member, wherein the shaft member includes an opening at a position on an upstream side of the conveyance unit and on a downstream side of the sheet member in a rotational direction of the shaft member.

11. The development device according to claim 10, wherein the opening is a through hole.

* * * * *